United States Patent [19]

Carruba

[11] Patent Number: 4,917,541

[45] Date of Patent: Apr. 17, 1990

[54] OFFSHORE SUPPORT STRUCTURE METHOD AND APPARATUS

[75] Inventor: Samuel C. Carruba, Houston, Tex.

[73] Assignee: CBS Engineering, Inc., Houston, Tex.

[21] Appl. No.: 391,436

[22] Filed: Aug. 9, 1989

[51] Int. Cl.[4] ..... E02B 17/02

[52] U.S. Cl. ..... 405/227; 405/204; 405/224

[58] Field of Search ..... 405/227, 224, 203, 204, 405/195, 202, 205, 209, 210, 217, 228

[56] References Cited

U.S. PATENT DOCUMENTS 4,679,964 7/1987 Blandford ..... 405/227 X 4,739,840 4/1988 Cox ..... 405/195 X 4,740,110 4/1988 Saffrhan ..... 405/225

4,781,497 11/1988 Karsan et al. ..... 405/204 X 4,842,446 6/1989 Carruba ..... 405/227

*Primary Examiner*—Dennis L. Taylor

*Attorney, Agent, or Firm*—Ben D. Tobor

[57] ABSTRACT

A method and apparatus for offshore support structures utilize a central support having three legs interconnected with an outrigger support structure comprised of at least two legs and at least one hollow pile is disposed within at least one leg of the central support, the hollow pile being fixedly secured to the tubular leg within which it is disposed.

9 Claims, 5 Drawing Sheets

OFFSHORE SUPPORT STRUCTURE METHOD AND APPARATUS

FIELD OF THE INVENTION

The invention relates to offshore support structure methods and apparatus for use with at least one well located in a body of water.

DESCRIPTION OF THE PRIOR ART

In the drilling of wells at offshore locations, many offshore structures have been provided which have platform structures mounted thereon to support various types of drilling units. Many of these offshore structures are exceedingly large, massive, and expensive. Many wells are drilled at offshore locations from a jack-up drilling rig or a semi-submersible drilling rig, and after the drilling process has been completed, a platform structure supported by some sort of support structure is still necessary for the production of the hydrocarbons. These platform structures are likewise quite expensive. It is thus desirable to reduce the cost of offshore support structures, so that the cost of placing a well into production is minimized. It would then be possible that some less productive, or marginal, offshore wells could be placed into production of hydrocarbons.

One common design of offshore support structure is a tripod support structure wherein a central conductor, or pipe, extending from the ocean floor to above the water surface is supported by three skirt piles spaced about the central conductor, the three skirt piles each being interconnected to the central conductor by a plurality of braces, as well as a plurality of braces extending between the three skirt piles. In this tripod type of offshore structure, a platform structure may be supported by the central conductor, and a plurality of wells may be disposed within the large diameter central conductor. Typically, a jack-up drilling rig is used to drill the wells; however, because of the braces running from each of the three skirt piles upwardly to the central conductor, difficulties may be encountered in maneuvering in the water to a position adjacent the central column, whereby drilling operations can be carried out. Another disadvantage associated with this type of structure is that the central conductor cannot transfer axial and lateral loads directly into the ocean floor, but rather all axial and lateral loads are transmitted into the ocean floor by the three skirt piles, whereby stronger bracing of the central conductor is required.

Another type of offshore structure would be a conventional platform structure supported by three or more tubular legs, which are secured to the ocean floor by a plurality of piles, the plurality of legs all extending above the surface of the water, and all of the legs requiring that a plurality of piles be driven from above the surface of the water, downwardly through the pile legs into the ground beneath the body of water. This structure typically is quite massive and costly to manufacture, in that the upper ends of each of the legs is subject to the forces exerted by wave action upon each of the legs.

Accordingly, prior to the development of the present invention, there have been no offshore support structure methods and apparatus which: are simple and economical to manufacture and use; require a minimum number of piles to be driven into the ground beneath the body of water; have a smaller wave load due to a reduced surface area upon which the water acts; more efficiently withstand axial loading; and have the capabilities of supporting major hydrocarbon production facilities.

Therefore, the art has sought offshore support structure methods and apparatus which: are simple and economical to manufacture and use; require a minimum number of piles to be driven into the ground beneath the body of water; have a smaller surface area upon which the water acts, thus reducing the wave loads; more efficiently withstand axial loading; and have the capabilities of supporting major hydrocarbon production facilities.

SUMMARY OF THE INVENTION

In accordance with the invention, the foregoing advantages have been achieved through the present support structure for use with at least one well located in a body of water. The present invention includes a central support structure having three tubular legs, each leg having upper and lower ends, the legs all having a length greater than the depth of the body of water, and the upper ends of each of the legs adapted to be disposed above the surface of the body of water; a single hollow pile disposed in at least one of the legs of the central support structure and adapted to be driven into the ground below the body of water, the at least one hollow pile having an upper and a lower end, extending outwardly and upwardly from the leg in which it is disposed and fixedly secured thereto; a first set of bracing members disposed between and interconnecting the three tubular legs of the central support structure; an outrigger support structure having at least two tubular legs, each leg having upper and lower ends, the legs each having substantially the same length, which length is substantially less than the depth of the body of water and a plurality of bracing members disposed between and interconnecting the at least two tubular legs; at least one pile disposed in each of the legs of the outrigger support structure and adapted to be driven into the ground below the body of water and fixedly secured to the leg; a second set of bracing members disposed between and interconnecting the outrigger support structure to the central support structure; and the at least one wall is disposed within the at least one hollow pile disposed in a leg of the central support structure, whereby the only portion of the support structure subject to wave action on the surface of the body of water is the upper end of the legs of the central support structure and each hollow pile disposed in a leg becomes part of the support structure and is capable of withstanding lateral and axial loads exerted upon the support structure.

A further feature of the present invention is that a platform structure is secured to the upper end of each hollow pile disposed in a leg of the central support structure and the upper ends of the legs of the central support structure not having a hollow pile disposed therein. Another feature of the present invention is that a third set of bracing members are disposed between and interconnecting the first set of bracing members, whereby additional wells, disposed between the third set of bracing members, may be placed in the ground below the body of water. A further feature of the present invention is that a mud mat is disposed adjacent the lower end of each leg of the central support structure and outrigger support structure.

In accordance with another aspect of the invention, the foregoing advantages have been achieved through the present method for installing a platform structure for use with at least one well located in a body of water. This aspect of the present invention includes the steps of: lowering a central support structure interconnected with an outrigger support structure to the ground beneath the body of water at a desired location in the body of water, the central support structure having three interconnected tubular legs and the outrigger support structure having at least two interconnected tubular legs and each leg having upper and lower ends; disposing the central support structure in the body of water with the upper ends of the three tubular legs extending above the surface of the body of water and the upper ends of the tubular legs of the outrigger support structure substantially below the surface of the body of water; driving a single hollow pile, having upper and lower ends, through at least one tubular leg of the central support structure extending above the surface of the body of water and into the ground beneath the body of water, and driving a single pile through each of the tubular legs of the outrigger support structure and into the ground beneath the body of water; disposing the upper end of each hollow pile to extend outwardly and upwardly from the upper end of the tubular leg through which the hollow pile has been driven; fixedly securing each hollow pile to the tubular leg through which each hollow pile has been driven; fixedly securing the piles to the tubular legs of the outrigger support structure; and securing the platform structure to the upper end of the legs of the central support structure not having a hollow pile disposed therein and to the upper end of each hollow pile, whereby each hollow pile becomes part of the support structure and is capable of withstanding lateral and axial loads exerted upon the support structure, and the only portion of the support structure subject to the substantial wave action at or near the surface of the body of water is the upper end of the legs of the central support structure, and the upper end of each hollow pile.

A further feature of the present method is the step of drilling at least one well through each hollow pile. An additional feature of the present method includes the step of disposing a mud mat adjacent the lower end of each tubular leg of the central support structure and the outrigger support structure.

The offshore support structure methods and apparatus for use with at least one well located in a body of water of the present invention, when compared with previously proposed prior art offshore support structure methods and apparatus, have the advantages of: being simple and economical to manufacture and use; require a minimum number of piles to be driven into the ground beneath the body of water; present a smaller surface area upon which the water acts, whereby there are smaller wave loads; more efficiently withstand axial and lateral loading; and have the capabilities of supporting major hydrocarbon production facilities.

Figure 1:
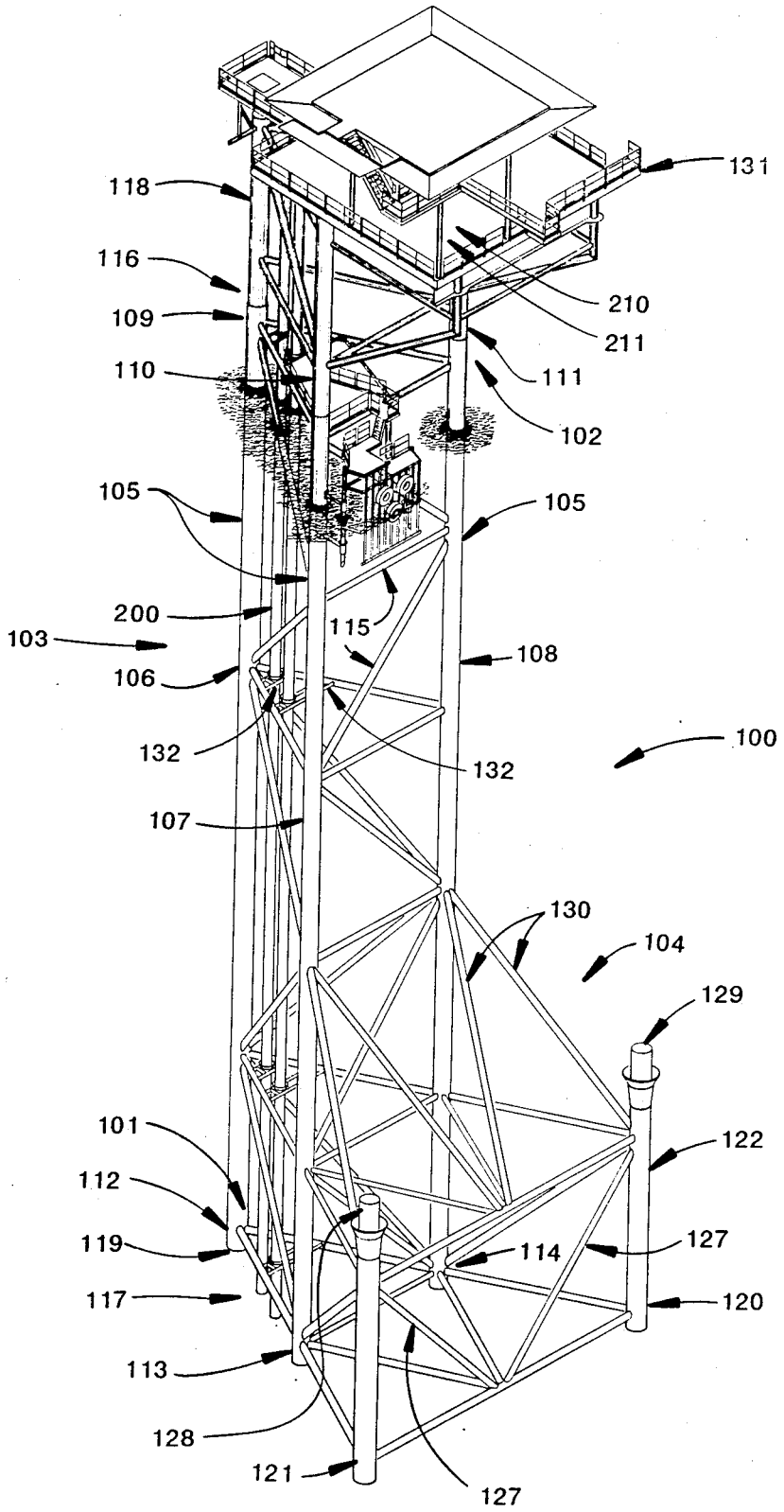
FIG. 1 is a perspective view of an offshore support structure in accordance with the present invention.
Figure 2:
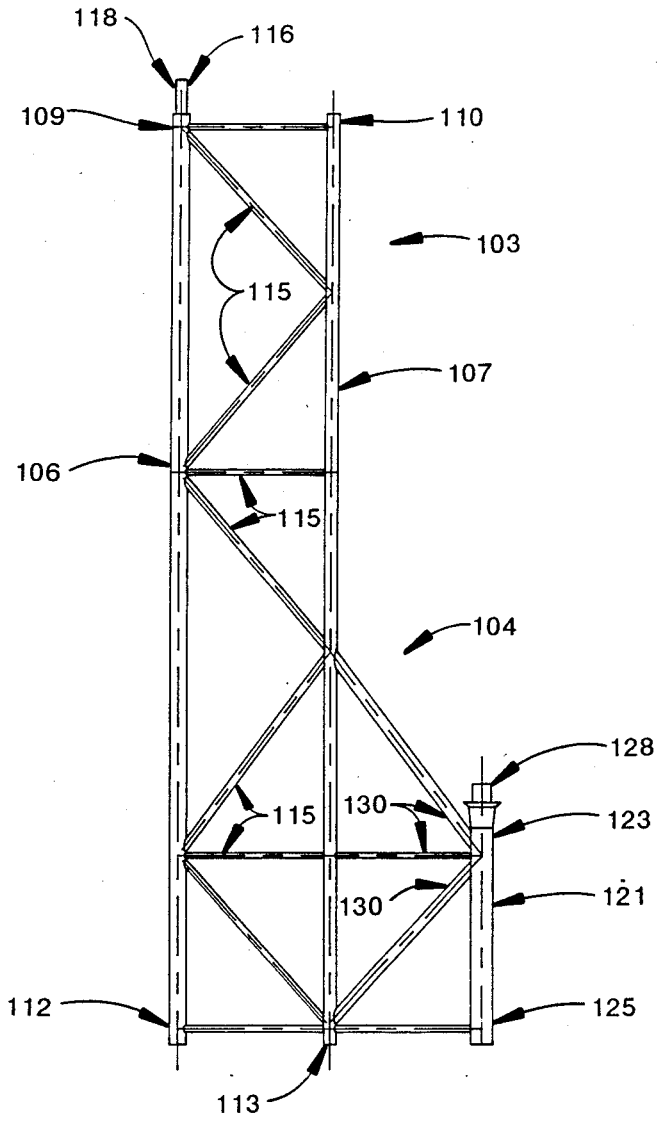
FIG. 2 is a side view of the offshore support structure of FIG. 1.
Figure 3:
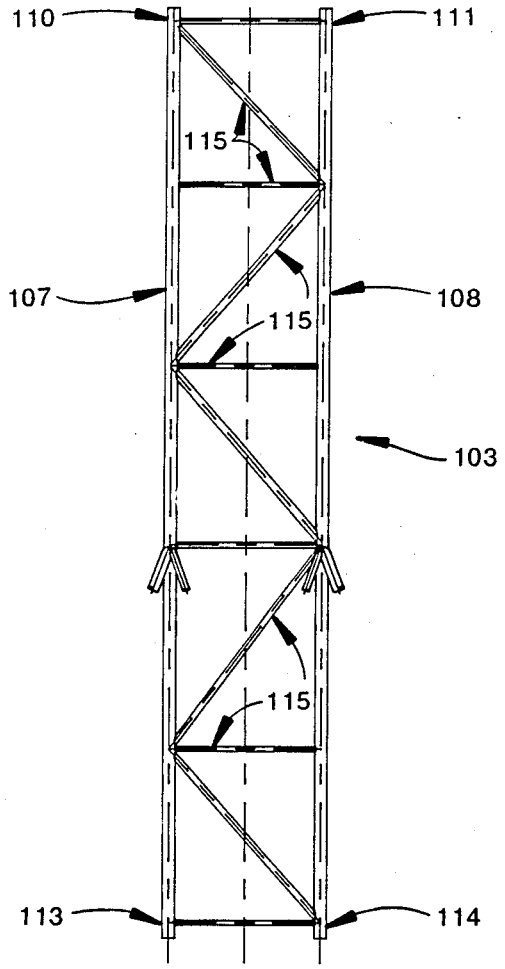
FIG. 3 is a rear view of the central support section of the offshore support structure of FIG. 1 with the outrigger support structure not completely shown.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

With reference to FIGS. 1–5 an offshore support structure 100 in accordance with the present invention is shown for use with at least one well 101 located in a body of water 102. Support structure 100 generally comprises a central support structure 103, and an outrigger support structure 104.

The central support structure 103 generally comprises a first set of legs 105 including three tubular legs 106–108, each leg having upper ends 109–111 and lower ends 112–114. All of the tubular legs 106–108 of the central support structure 103 have a length greater than the depth of the body of water 102. As seen in FIG. 1, the upper ends 109–111 of the legs 106–108 are adapted to be disposed above the surface of the body of water 102. A first set of bracing members 115 is disposed between and interconnecting the three tubular legs 106–108 to provide rigidity to the central support structure 103. The first set of bracing members 115 may be disposed between, and interconnecting the tubular legs 106–108 in any suitable manner so as to provide the necessary support and rigidity to offshore support structure 100.

With reference to FIGS. 1–4, a single hollow pile 116 is preferably disposed in at least one of the legs 106–108 of the central support structure 103, and is adapted to be driven into the ground 117 below the body of water 102, in a conventional manner. Preferably, hollow pile 116 is disposed within leg 106. The at least one hollow pile 116, has upper and lower ends 118–119, the lower end 119 being driven into the ground 117 below the body of water 102 and the upper end 118 of the at least one hollow pile 116 extending outwardly and upwardly from the leg 106 in which the hollow pile 116 is disposed. The hollow pile 116 is preferably fixedly secured to the leg 106 in which it is disposed, as by welding or grouting hollow pile 116 to the upper end 109 of the leg 106 in which the hollow pile 116 is disposed, or by a segmented sleeve, or conventional coupling, or in any other suitable manner so as to provide a secure connection between the hollow pile 116 and the leg 106 in which it is disposed. After a hollow pile 116 has been driven through a leg 106 into the ground 117 beneath the body of water 102, and after it has been fixedly secured to the leg 106, in which it is disposed, in the manner previously described, hollow pile 116 and leg 106 thus become capable of not only withstanding lateral loads, but axial loads exerted upon the support structure 100, in that hollow pile 116 and leg 106 have become an integral part of support structure 100.

Figure 4:
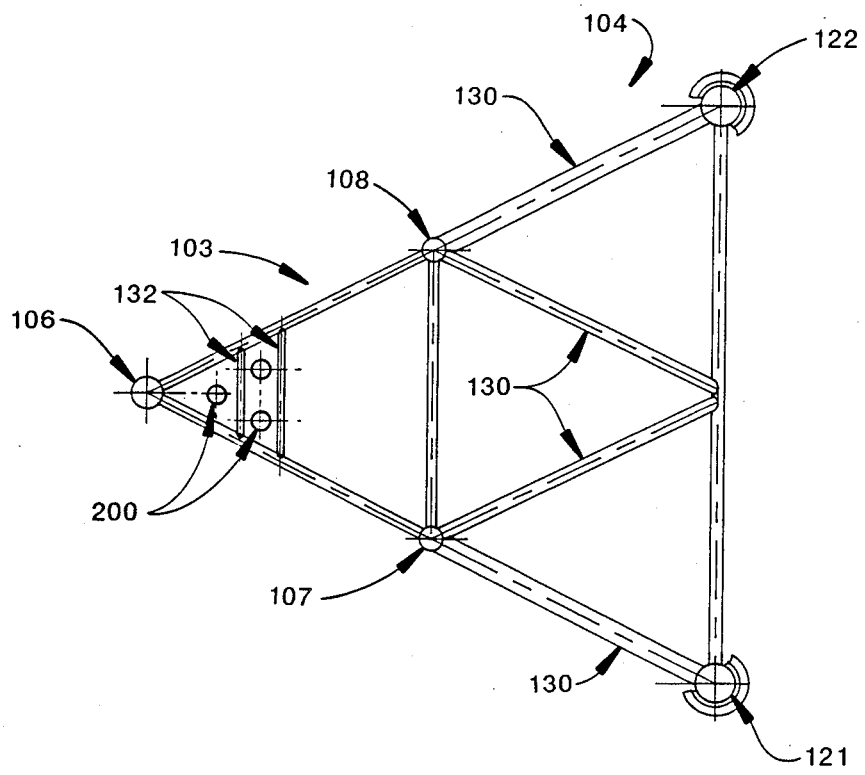
FIG. 4 is a top view of the offshore support structure of FIG. 1.
Figure 5:
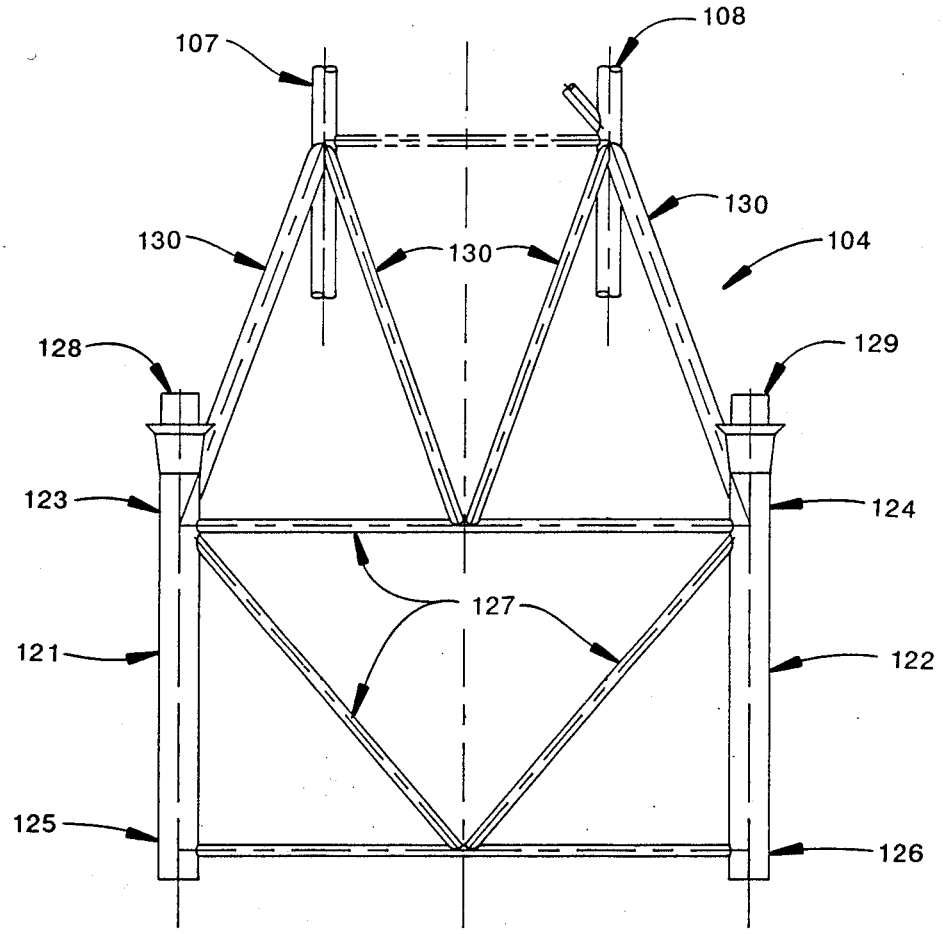
FIG. 5 is a rear view of the outrigger support section of the offshore support structure of FIG. 1 with the central support structure not completely shown.

Although a hollow pile 116 may be disposed in any one of the legs 106–108 or any number of the legs 106–108 of the central support structure 103, if only one hollow pile 116 is used, it is preferable to dispose that hollow pile 116 in the leg 106 which is at the apex of the triangle formed from a top view of the support structure 100 as seen in FIG. 4.

The outrigger support structure 104, as shown in FIGS. 1–2 and 4–5 has a second set of legs 120 generally comprised of at least two tubular legs 121,122, each leg having upper ends 123,124 and lower ends 125,126. Each of the tubular legs 121,122 of the outrigger support structure 104 has substantially the same length, which length is substantially less than the depth of the body of water 102. A plurality of bracing members 127 are disposed between and interconnecting the at least two tubular legs 121,122 to provide rigidity to the outrigger support structure 104. The bracing members 127 may be disposed between and interconnecting the legs 121,122 of the outrigger support structure 104 in any suitable manner, so as to provide the necessary support and rigidity to the offshore support structure 100. As shown in FIGS. 1–2 and 4–5, at least one pile 128,129 is preferably disposed in each of the legs 121,122 of the outrigger support structure 104 and is adapted to be driven into the ground 117 below the body of water 102, in a conventional manner. Each pile 128,129 is fixedly secured in a conventional manner to the leg 121,122 in which it is disposed, such as by use of segmented sleeves, couplings, welding or as by grouting.

As shown is FIGS. 1–2 and 4–5, a second set of bracing members 130 is disposed between and interconnecting the central support structure 103 to the outrigger support structure 104. The second set of bracing members 130, along with bracing members 127, provide the necessary support and rigidity to the offshore support structure 100 and may be disposed between and interconnecting the central support structure 103 and outrigger support structure 104 in any suitable manner.

Therefore, as shown in FIG. 1, the central support structure 103 is interconnected by bracing members 130 to the outrigger support structure 104 forming the offshore support structure 100. As seen in FIG. 1, the only portion of the offshore support structure 100 subject to wave action on the surface of the body of water 102 is the upper ends 109–111 of the legs 106–108 of the central support structure 103 and the hollow pile 116 disposed in leg 106. Each hollow pile 116 and the leg 106–108 in which it is a part of the offshore support structure 100 and is capable of withstanding lateral and axial loads exerted upon the offshore support structure 100.

As shown in FIG. 1, a conventional platform structure 131 may be secured to the upper end 118 of each hollow pile 116 disposed in a leg 106–108 of the central support structure 103 and the upper ends 109–111 of the legs 106–108 of the central support structure 103 not having a hollow pile 116 disposed therein. It should be noted that platform structure, or deck, 131 is disposed in an offset relationship from the at least one well 101, whereby more efficient use may be made of the surface area of the deck. By use of the term "offset relationship" is meant that the major portion of the surface area 211 of the deck 131 does not surround the area where the at least one well 101 passes through the deck 131.

Dependent upon the design and construction of the platform structure 131, wells, such as well 101 may be drilled into the ground 117 beneath the body of water 102, either before or after production platform 131 has been secured to hollow pile 116 and legs 106–108. The wells, such as well 101, may be drilled in a conventional manner by a jack-up rig, or a semi-submersible drilling rig. Preferably, the at least one well 101 is disposed within the at least one hollow pile 116 disposed within a leg 106–108 of the central support structure 103, and additional wells may be disposed in each hollow pile disposed in each leg 106–108 of the central support structure 103, as well as in the legs 106–108 which do not have a hollow pile 116 disposed therein. A third set of bracing members 132 may be disposed between and interconnecting the first set of bracing members 115, as illustrated in FIGS. 1 and 4. Additional desired wells 200, may be drilled directly into the ground 117, as shown in FIGS. 1 and 4. Alternatively, additional hollow piles, similar in construction and design to hollow pile 116, may first be disposed adjacent the third set of bracing members 132, and the desired wells 200 then drilled through the additional hollow piles. A mud mat (not shown) may be disposed adjacent the lower end 112–114 of each leg 106–108 of the central support structure 103 and adjacent the lower end 125–126 of each leg 121–122 of the outrigger support structure 104 to prevent the lower ends of legs 106–108 and legs 121–122 from sinking into potentially soft ground 117 before the hollow pile 116 can be driven through at least one leg 106–108 of the first set of legs 105 and before the piles 128–129 are driven through the second set of legs 120.

With reference to FIGS. 1 to 5, a method for installing a platform structure 131 for use with at least one well 101 in a body of water 102 will be described. In a conventional manner, offshore support structure 100 is transported to the desired location on the body of water 102. In a conventional manner, offshore support structure 100 comprised of a central support structure 103 interconnected with an outrigger support structure 104 is lowered to the ground 117 beneath the body of water 102, whereby the lower ends 112–114 of the three tubular legs 106–108 of the central support structure 103 and the lower ends 125–126 of the at least two tubular legs 121,122 of the outrigger support structure 104, rest upon the ground 117 as shown in FIG. 1. The upper ends 109–111 of the legs 106–108 of the central support structure 103 extend above the surface of the body of water 102 and the upper ends 123,124 of the legs 121,122 of the outrigger support structure 104 are disposed substantially below the surface of the body of water 102 as shown in FIG. 1. A single hollow pile 116 is driven through at least one tubular leg 106–108 of the central support structure 103 extending above the surface of the body of water 102 and the lower end 119 of the hollow pile 116 is driven into the ground 117 beneath the body of water 102. In this regard, hollow pile 116 may be either pre-installed within a tubular leg 106–108 or it may be lowered into a tubular leg 106–108 in a conventional manner. A single pile 128,129 may then be driven in a conventional manner through each of the legs 121,122 of the outrigger support structure 104 and into the ground 117 beneath the body of water 102. Preferably piles 128,129 are pre-assembled and lowered within legs 121,122.

With reference to FIG. 1, as previously described, the upper end 118 of each hollow pile 116 is disposed to extend outwardly and upwardly from the upper end 109–111 of the tubular legs 106–108 through which the hollow pile 116 has been driven. The hollow pile 116 is then fixedly secured to the tubular leg 106–108 through which the hollow pile 116 has been driven, in the manner previously described. Likewise, piles 128, 129 may preferably be secured to legs 121,122 of the outrigger support structure 104, in the manner previously described, such as by grouting. As previously described, wells may be drilled through the hollow pile 116. Alternatively, platform structure 131 may be secured to the upper end 118 of each hollow pile and the upper end 109–111 of each leg 106–108 of the central support structure 103 not having a hollow pile 116 disposed therein, and a well is subsequently drilled through each hollow pile 116. Likewise, additional wells may be provided as previously described in connection with FIGS. 1 and 4.

When compared with previously proposed prior art offshore structure methods and apparatus, the offshore structure 100 of the present invention has the following advantages. Wave loads on the structure 100 are reduced in that the surface area upon which the water 102 acts is much smaller since only the upper end of the hollow pile 116 and the upper end of each leg 106–108 of the central support section 103 is acted upon by the higher wave pressure forces at or near the surface of the body of water. Additionally, by placing a well within the hollow pile, which is disposed within one of the legs of the support structure, the wave loads are reduced because the wave pressure forces do not act upon the surface area of that well, which would be the case if it were disposed outside of the leg of the support structure. Because the wave loads are reduced, the cost of the offshore structure 100 is reduced in that the offshore structure 100 can be lightened and thus use less steel in its construction. The pilling requirements of offshore structure 100 is also less than other types of offshore support structures since the legs 106–108 of the central support section 103, having no hollow pile 116 disposed therein for a well, need no piles for stability; the piles 128,129 used with the outrigger support section 104 are shorter than those conventionally used; and the piles 128,129 can be pre-assembled as previously described resulting in time and labor savings. Since the structure 100 is lighter in weight than conventional, prior art offshore support structure, additional savings can be obtained because the mud mats can be made smaller, because less weight is being supported. Additionally, it is easier for a jack-up rig to be maneuvered adjacent the support structure 100, because there are no braces on one side of the structure 100. Although the support structure 100 is lighter in weight than conventional, prior art offshore support structures, the support structure 100 may be used as a major production facility for the production of hydrocarbons.

It should be noted that the support structure 100 of the present invention may also be utilized in connection with previously drilled wells in offshore locations, wherein the well has been drilled and a conductor pipe extends above the ground 117. In these situations, typically four to ten feet of conductor pipe (not shown) is left extending above the ground 117, until it is desired for production operations to begin. The structure 100 of the present invention may be utilized in connection with such previously drilled wells, by providing either the lower end 112–114 of any leg 106–108 of the central support structure 103, with a tubular guide having a funnel shaped portion (not shown), or by providing such a tubular guide outside and adjacent the lower end of the any of the legs 106–108. Thus, as offshore support structure 100 is lowered to the ground 117 beneath the body of water 102, the pre-existing conductor pipe can be mated with the tubular guide (not shown), whereby offshore support structure 100 would be located above the desired location where it is desired to drill additional wells, or to place the existing, previously drilled well into production.

It is to be understood that the invention is not limited to the exact details of construction, operation, exact materials or embodiments shown and described, as obvious modifications and equivalents will be apparent to one skilled in the art; for example, different bracing member configurations could be utilized or the support structure could be used without a well. Accordingly, the invention is therefore to be limited only by the scope of the appended claims.

I claim:

1. An offshore support structure for use with at least one well located in a body of water, comprising:

a central support structure having three tubular legs, each leg having upper and lower ends, the legs all having a length greater than the depth of the body of water, and the upper ends of each of the legs adapted to be disposed above the surface of the body of water;

a single hollow pile disposed in at least one of the legs of the central support structure and adapted to be driven into the ground below the body of water, the at least one hollow pile having an upper and a lower end, and extending outwardly and upwardly from the leg in which it is disposed and fixedly secured thereto;

a first set of bracing members disposed between and interconnecting the three tubular legs of the central support structure;

an outrigger support structure having at least two tubular legs, each leg having upper and lower ends, the legs each having substantially the same length, which length is substantially less than the depth of the body of water and a plurality of bracing members disposed between and interconnecting the at least two tubular legs;

at least one pile disposed in each of the legs of the outrigger support structure and adapted to be driven into the ground below the body of water and fixedly secured to the leg;

a second set of bracing members disposed between and interconnecting the outrigger support structure to the central support structure; and the at least one well is disposed within the at least one hollow pile disposed in a leg of the central support structure, whereby the only portion of the support structure subject to wave action on the surface of the body of water is the upper end of the legs of the central support structure and each hollow pile disposed in a leg becomes part of the support structure and is capable of withstanding lateral and axial loads exerted upon the support structure.

2. The support structure of claim 1 wherein a platform structure is secured to the upper end of each hollow pile disposed in a leg of the central support structure and the upper ends of the legs of the central support structure not having a hollow pile disposed therein.

3. The support structure of claim 2, wherein the platform structure is disposed in an offset relationship from the at least one well.

4. The support structure of claim 1, wherein a third set of bracing members are disposed between and interconnecting the first set of bracing members, whereby additional wells, disposed adjacent the third set of bracing members, may be placed in the ground below the body of water.

5. The support structure of claim 1, wherein a mud mat is disposed adjacent the lower end of each leg of the central support structure and outrigger support structure.

6. The method for installing a platform structure for use with at least one well located in a body of water, comprising the steps of:

lowering a central support structure interconnected with an outrigger support structure to the ground beneath the body of water at a desired location in the body of water, the central support structure having three interconnected tubular legs and the outrigger support structure having at least two interconnected tubular legs and each leg having upper and lower ends;

disposing the central support structure in the body of water with the upper ends of the three tubular legs extending above the surface of the body of water and the upper ends of the tubular legs of the outrigger support structure substantially below the surface of the body of water;

driving a single hollow pile, having upper and lower ends, through at least one tubular leg of the central support structure extending above the surface of the body of water and into the ground beneath the body of water, and driving a single pile through each of the tubular legs of the outrigger support structure and into the ground beneath the body of water;

disposing the upper end of each hollow pile to extend outwardly and upwardly from the upper end of the tubular leg through which the hollow pile has been driven;

fixedly securing each hollow pile to the tubular leg through which the hollow pile has been driven;

securing the platform structure to the upper end of the legs of the central support structure not having a hollow pile disposed therein, and to the upper end of each hollow pile, whereby each hollow pile becomes part of the support structure and is capable of withstanding lateral and axial loads exerted upon the support structure, and the only portion of the support structure subject to wave action on the surface of the body of water is the upper end of the legs of the central support structure, and the upper end of each hollow pile.

7. The method of claim 6, including the step of drilling at least one well through each hollow pile.

8. The method of claim 6, including the step of disposing a mud mat adjacent the lower end of each tubular leg of the central support structure and the outrigger support structure.

9. The method of claim 6, including the step of securing the platform structure in an offset relationship from the at least one well.

* * * * *